US005755416A

United States Patent [19]

Leek

[11] Patent Number: 5,755,416

[45] Date of Patent: May 26, 1998

[54] L-SHAPED SHELF BRACKET WITH A FRICTIONALLY ENGAGING STRUT MEMBER

[75] Inventor: William F. Leek, Anaheim, Calif.

[73] Assignee: Simpson Strong-Tie Company, Inc., Pleasanton, Calif.

[21] Appl. No.: 632,257

[22] Filed: Apr. 15, 1996

[51] Int. Cl.[6] ..... E04G 3/08

[52] U.S. Cl. ..... 248/247; 211/90

[58] Field of Search ..... 248/235, 351, 248/247, 224.8, 544, 456, 242; 211/90

[56] References Cited

U.S. PATENT DOCUMENTS

| | | | |
|---|---|---|---|
| 498,027 | 5/1893 | Recht | 248/247 |
| 1,047,980 | 12/1912 | Parsons | 248/247 |
| 1,468,813 | 9/1923 | Huff | 248/247 |
| 2,477,771 | 8/1949 | Sanford | 248/247 |
| 3,070,337 | 12/1962 | Gates | 248/235 X |
| 3,113,678 | 12/1963 | Dickinson et al. | 211/90 |
| 3,669,395 | 6/1972 | Gehrke | 211/90 X |
| 3,916,477 | 11/1975 | Baker, Sr. | 248/235 X |

FOREIGN PATENT DOCUMENTS

| | | | |
|---|---|---|---|
| 808220 | 1/1959 | United Kingdom | 211/90 |

OTHER PUBLICATIONS

Simpson Strong-Tie Co., Inc. catalog copyright 1994, p. 65.
Side view drawing of German Shelf Bracket.
4 photographs of German Shelf Bracket.

*Primary Examiner*—Robert W. Gibson, Jr.
*Assistant Examiner*—Stephen S. Wentsler
*Attorney, Agent, or Firm*—James R. Cypher

[57] ABSTRACT

A shelf bracket composed of a generally L-shaped bracket member and a strut member connected to distal ends of the bracket member. The bracket member comprises a perimeter flange extending angularly from substantially the entire perimeter of the bracket member and extending as an unbroken continuous structural element at the distal ends of the bracket member. The strut member comprises a projection at one end that engages a socket formed in one of the distal ends of the bracket member. The strut member comprises another end frictionally engaging an inside surface portion of the perimeter flange at the other distal end of the bracket. A fastener increases the strength of the connection of the strut and bracket member and is located at the distal end of the bracket member that frictionally engages the strut member. The bracket member further includes a projection spaced from the socket for releasably engaging the strut member for inhibiting withdrawal of the strut member from the socket.

7 Claims, 4 Drawing Sheets

L-SHAPED SHELF BRACKET WITH A FRICTIONALLY ENGAGING STRUT MEMBER

BACKGROUND OF THE INVENTION

Shelf brackets commonly have an L-shape with one end of the bracket attached to the frame of a wall and the other end supporting a shelf. This shelf bracket is formed in a generally L-shape and in addition has a strut member angularly running between the horizontal and vertical members to provide additional strength where the shelf loads to be carried are substantial. The prior art teaches that additional strength may be obtained by adding flanges to both the L-shaped member and the strut member, but such flanges in the prior art are not continuous at certain vital areas nor are they completely around the perimeter.

The use of strut members impedes installation in that the strut is in the way of the affixing device; be it a hammer or a screw driver.

It is known to form the L-shaped member and the strut members as separate parts so that the L-shaped member can be affixed to both the wall and the shelf member prior to placement of the strut member but such prior art brackets lack a snap-in feature to aid in the installation.

SUMMARY OF THE DISCLOSURE

The present shelf bracket is formed with a substantially continuous flange which in the preferred form encompasses the entire perimeter of the L-shaped member.

The perimeter flange of the L-shaped member further serves to releasably engage the end of the strut member.

An object of the shelf bracket of present invention is to provide the strongest load bearing shelf bracket with the least amount of metal. Another object is to provide a two piece shelf bracket which is easy to install as well as disassemble.

A further object of the present shelf bracket is to provide a device which is aesthetically pleasing as well as exceptionally functional.

BRIEF DESCRIPTION OF THE INVENTION

Figure 2:
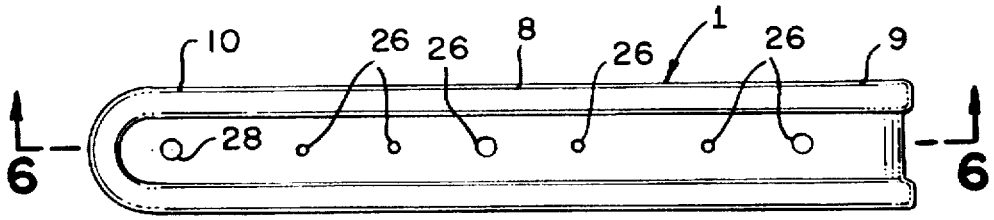
FIG. 2 is a top plan view of the shelf bracket taken in the direction of arrows 2 as shown in FIG. 1
Figure 1:
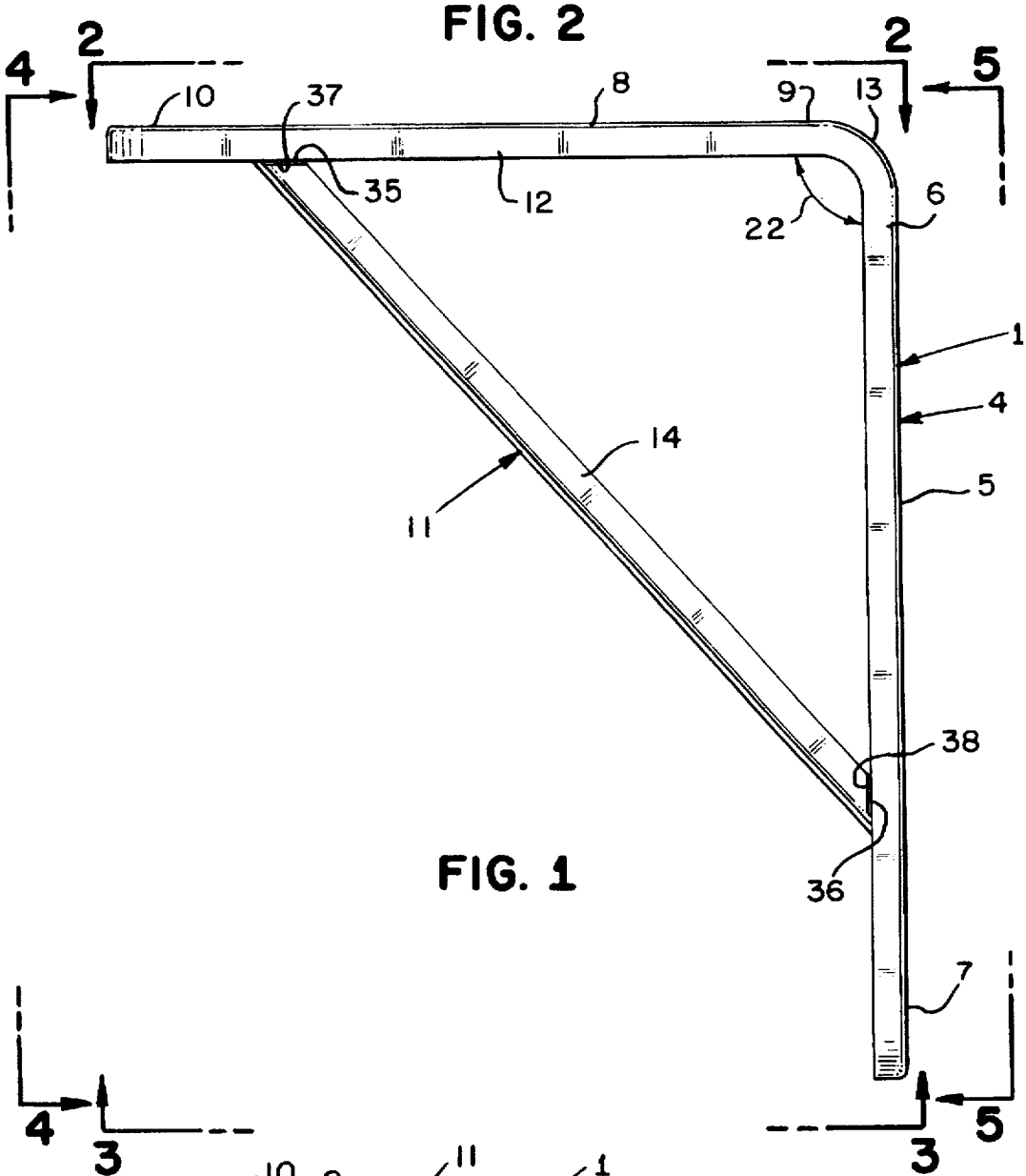
FIG. 1 is a side view of the shelf bracket of the present invention.
Figure 3:
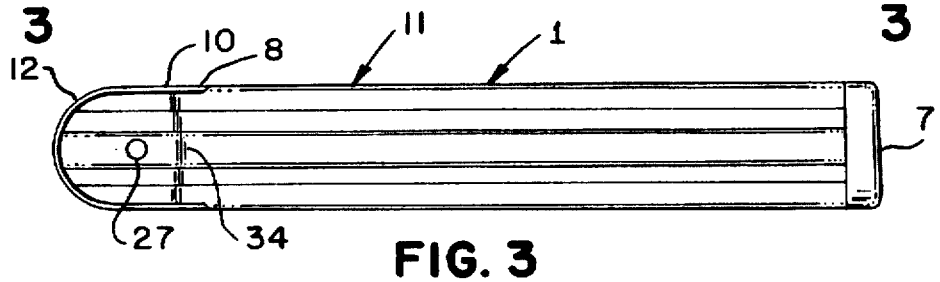
FIG. 3 is an underside plan view of the shelf bracket taken in the direction of lines 3—3 in FIG. 1.

The present invention is a shelf bracket 1 for attachment to a generally vertical structure 2 and for holding a generally horizontal shelf member 3 which includes: a generally L-shape member 4 having a first elongated member 5 including a proximal section 6 and a distal section 7 for selectable attachment to either the generally vertical structure 2 or the generally horizontal shelf member 3 and a second elongated member 8 for selectable attachment to either the generally vertical structure 2 or to the generally horizontal shelf member 3 having a proximal section 9 integrally attached to the proximal section 6 of the first elongated member 5 and a distal section 10; a strut member 11 dimensioned to extend between and engage the distal sections 7 and 10 of the first elongated member 5 and second elongated member 8; and a perimeter flange 12 extending angularly from substantially the entire perimeter of the generally L-shaped member 4.

In a preferred form, the shelf bracket 1 as previously described is formed so that the perimeter flange 12 extends as an unbroken continuous structural element at the intersection 13 of the proximal sections 6 and, 9 of the first and second elongated members 5 and 8. In another preferred form of the shelf bracket 1 as illustrated in the drawings the perimeter flange 12 extends as an unbroken continuous structural element at the distal ends 7 and 10 of the first and second elongated members 5 and 8.

Preferably, shelf bracket 1 is constructed so that the strut member 11 is formed with a first flange 14 and a second flange 15 dimensioned and constructed for engagement with the perimeter flange 12 of the first and second elongated members 5 and 8.

The shelf bracket of the present invention could be made as a single unit, but preferably shelf bracket 1 is constructed of two separable elements; viz., the L-shaped member 4 and the strut member 11. When constructed with two separable elements; one of the first elongated members 5 or the second elongated member 8 is formed with a socket 16 permitting releasable attachment of the strut member 11 to the generally L-shaped member 4. The strut member 11 preferably includes a first end section 17 formed with a projection 18 dimensioned for releasable receipt within the socket 16 which is formed in the generally L-shaped member 4. Finally, the strut member 11 is formed with a second end section 19 and dimensioned so that the distal edge 20 of the second end section 19 frictionally engages the inside surface portion 21 of the perimeter flange 12 at the distal section 10 of the other of the first 5 or second 8 elongated members. This construction provides the so called "snap-in" function" described in more detail below.

When the shelf bracket 1 is constructed of two separable elements, the strut member 11 as described above, is preferably formed with first flange 14 and second flange 15 dimensioned and constructed for engagement with the perimeter flange 12 of the first elongated member 5 and second elongated member 8.

Figure 7:
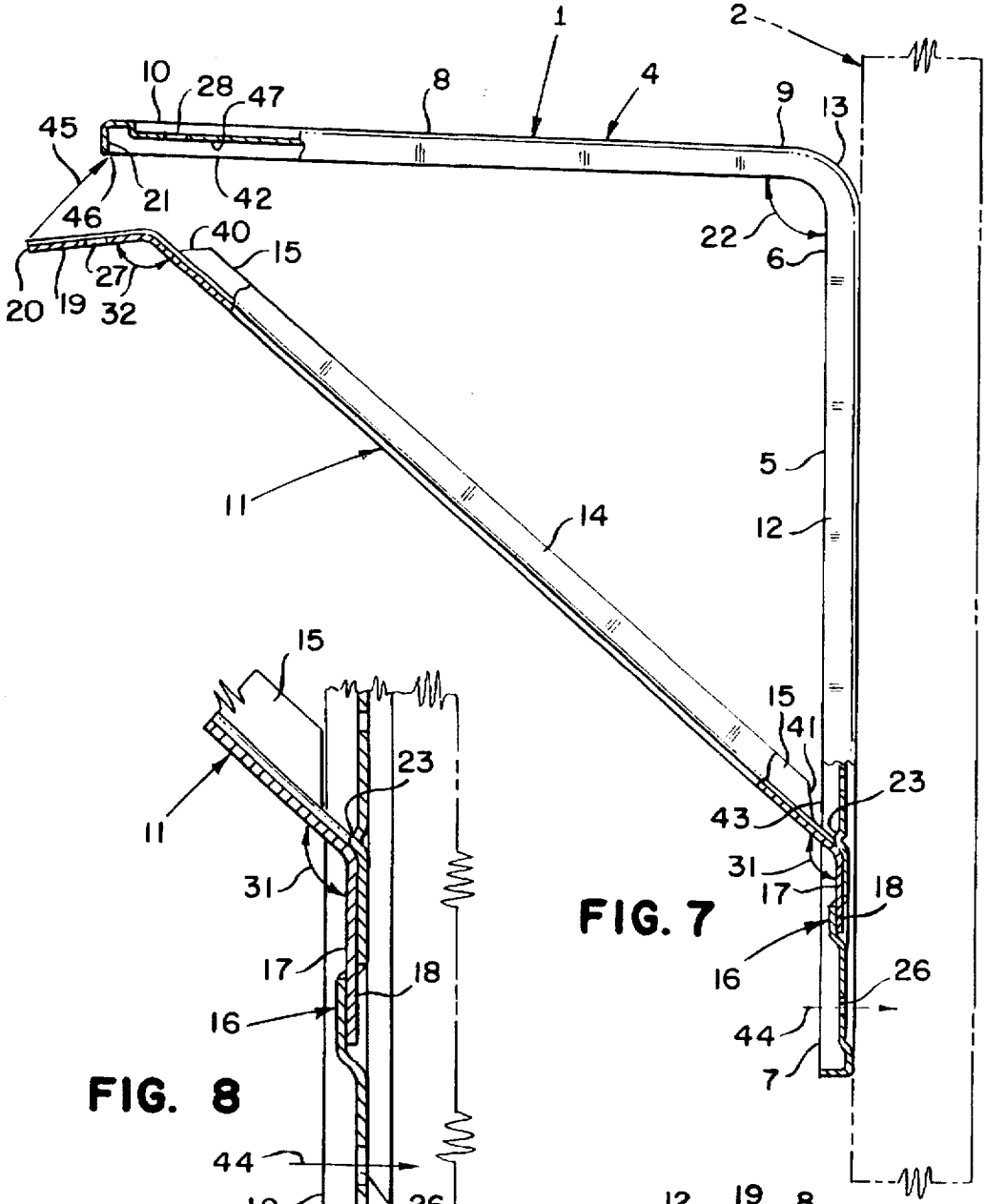
FIG. 7 is a side view of the shelf bracket shown in FIG. 1 with portions in cross section and with the strut member shown in a position just prior to engagement with the L-shaped member.

Referring to FIG. 7, it may be seen that shelf bracket 1 is constructed so that the strut member 11 and the generally L-shaped member 4 are dimensioned so that when the projection 18 on the strut member 11 has been received by the socket 16 formed in the generally L-shaped member 4, the distal edge 20 of the strut member 11 extends beyond the inside surface portion 21 of the perimeter flange 12 on the distal section 10 of the second elongated member 8 of the generally L-shaped member 4 and can only be received in engagement with the generally L-shaped member 4 by increasing the angle 22 formed by the first 5 and second 8 elongated members; and the second end section 19 of the strut member 11 is frictionally held by the perimeter flange permitting snap-in engagement of the strut member 11 with the generally L-shaped member 4. To insure that the strut member 11 will be frictionally engaged, angle 22 is initially formed to be about 88°. Thus when strut member 11 has been snapped into place and the angle 22 is now approximately 90°, the residual spring in generally L-shaped member 4 will attempt to bring the first and second elongated members 5 and 8 back to their original pre-bent position in which angle 22 was originally set at 88° thus holding distal edge 20 of second end section 19 in frictional engagement with inside surface portion 21 of perimeter flange 12 in close frictional engagement.

As illustrated in FIGS. 7, 8, 10 and 13 shelf bracket 1 is preferably constructed so that the elongated member 5 of the generally L-shaped member 4 formed with the socket 16 is formed with a projection 23 spaced from the socket 16 and dimensioned for releasably engaging the strut member 11 for inhibiting withdrawal of the strut member 11 from the socket 16.

To increase the holding strength of shelf bracket 1, the strut member 11 may be formed with an elongated indented section 24 running substantially the length of the strut member 11; and the generally L-shaped member 4 is formed with an elongated indented section 25 running substantially the length of the generally L-shaped member 4.

Preferably, shelf bracket 1 as previously described is constructed so that the generally L-shaped member 4 is formed with fastener openings 26 to facilitate the passage of fasteners therethrough into the generally horizontal shelf member 3 and the generally vertical structure 2; and the second end section 19 of the strut member 11 is formed with a fastener opening 27 in registration with one of the fastener openings 28 in the generally L-shaped member 4 for clamping the strut member 11 to the generally L-shaped member 4.

In the preferred form of the invention the shelf bracket 1 is constructed so that the first and second end sections 17 and 19 of the strut member 11 are free of the first and second flanges 14 and 15 and are formed with first and second angular bends 31 and 32 made at bend lines 33 and 34 so that the first and second end sections 17 and 19 of the strut member 11 lie in generally face to face registration with the distal sections 7 and 10 of the first and second elongated members 5 and 8 of the generally L-shaped member 4. As shown, first and second angular bends 31 and 32 may be approximately 45° and 50° respectively.

The shelf bracket of the present invention was developed to meet the needs of consumers for a heavy duty shelf bracket which can meet the structural and aesthetic needs for shelving in home offices, home and commercial kitchens, children's rooms and family rooms. Such shelving must be capable of holding such heavy objects as computers, television sets and other heavy objects.

To meet these functional needs, the bracket of the present invention may be made of 14 gauge steel and has been tested at loads of 2,000 lbs. which is approximately double the capacity of various shelf brackets on the market.

Examples of two different sizes of shelf brackets made in accordance with the present invention are as follows: First elongated member 5 may have a length of approximately 11", second elongated member 8 may have a length of approximately 9" with a width of about 1⅜". Perimeter flange 12 may have a depth of about 5/16". Strut member 11 may have an overall length in the bent mode of about 12⅝" and first and second flanges may have a depth of about ⅞".

A second size bracket may have a first elongated member 5 with a length of approximately 13", second elongated member 8 may have a length of approximately 11" with a width of about 1⅜". Perimeter flange 12 may 30 have a depth of about 5/16". Strut member 11 may have an overall length in the bent mode of about 15⅝" and first and second flanges may have a depth of about ⅞".

Figure 9:
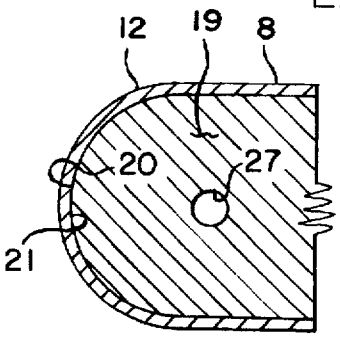
FIG. 9 is an enlarged sectional view of a portion of the shelf bracket taken generally along lines 9—9 in FIG. 6.
Figure 10:
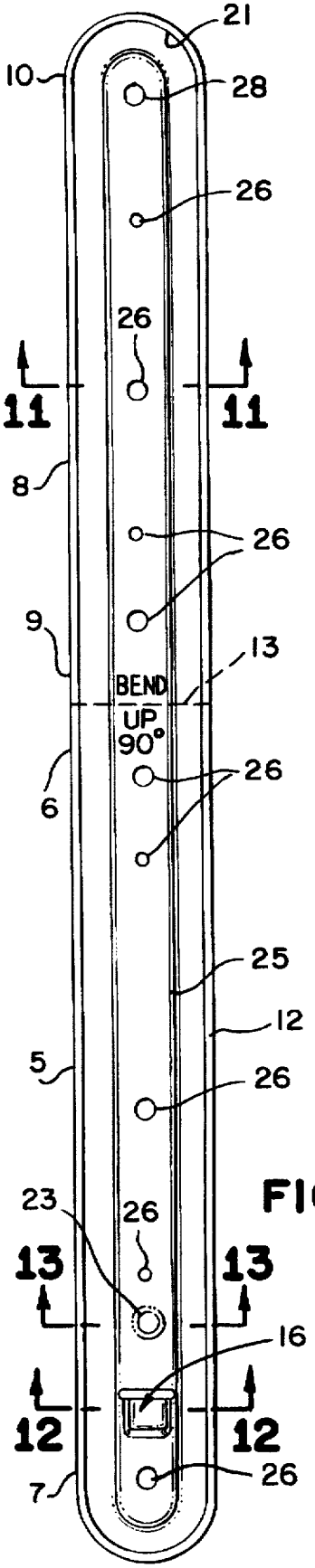
FIG. 10 is view of the L-shaped portion of the shelf bracket just prior to bending up 90° as indicated. The view shows the inside of the L-shaped portion as it would be seen if taken along arrows 4—4 of FIG. 1.
Figure 11:
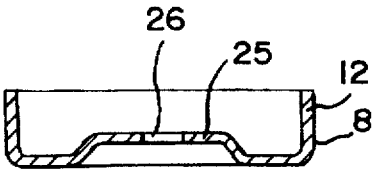
FIG. 11 is a cross section taken along line 11—11 of FIG. 10.
Figure 12:
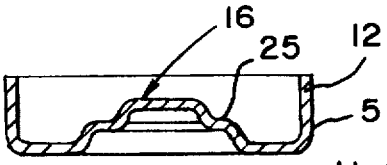
FIG. 12 is a cross section taken along line 12—12 of FIG. 10.
Figure 13:
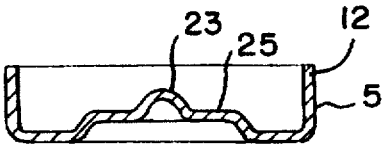
FIG. 13 is a cross section taken along line 13—13 of FIG. 10.
Figure 14:
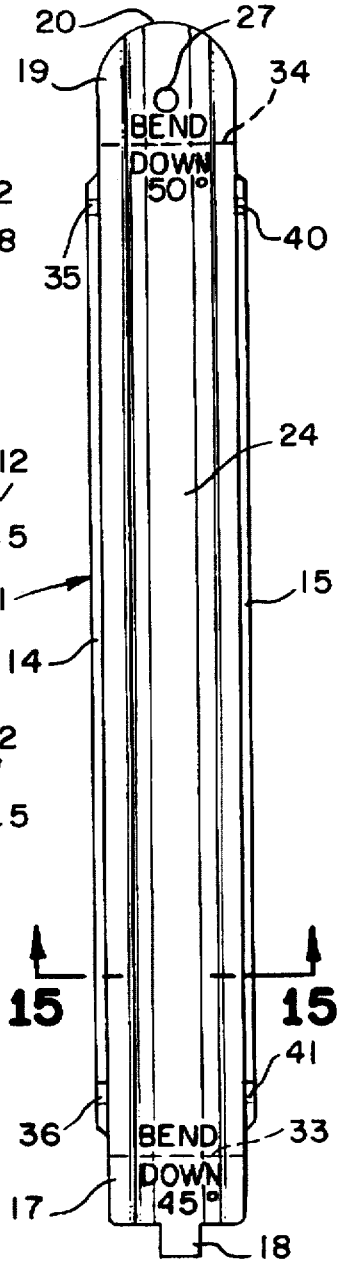
FIG. 14 is view of the strut member as it would appear prior to bending along the bend lines illustrated.
Figure 15:
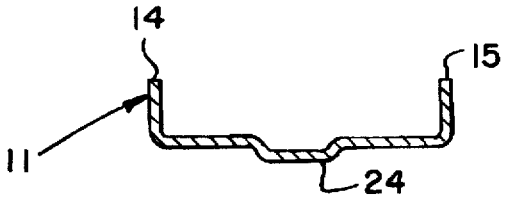
FIG. 15 is a cross section taken along line 15—15 in FIG. 14.

The great strength of the bracket of the present invention is attributable to several factors. First, the use of a continuous perimeter flange 12 which is believed to be unique in the shelf bracket industry adds great strength. Second the brace member 11 is formed with first and second flanges 14 and 15 which give stiffness to the strut member 11, but also the unique dimensions of the elements are dimensioned and positioned such that end edges 35 and 36 of opposite ends of first flange 14 of strut member 11 contact edge portions 37 and 38 of perimeter flange 12 on second elongated member 8 and first elongated member 5 respectively and end edges 40 and 41 of opposite ends of second flange 15 of strut member 11 contact edge portions 42 and 43 of perimeter flange 12 on second elongated member 8 and first elongated member 5 respectively. When both parts of the bracket are assembled the flanges bearing against each other make a continuous force path. As illustrated in FIG. 9, second end section 19 of strut member 11 fits snugly against inside surface portion 21 of drawn flange 12 to prevent slippage of the strut member 11 thus holding the end edges 40, 41, 35 and 36 of first and second flanges 14 and 15 in contact with the portions 42,43, 37 and 38 of peripheral flange 12.

Figure 8:
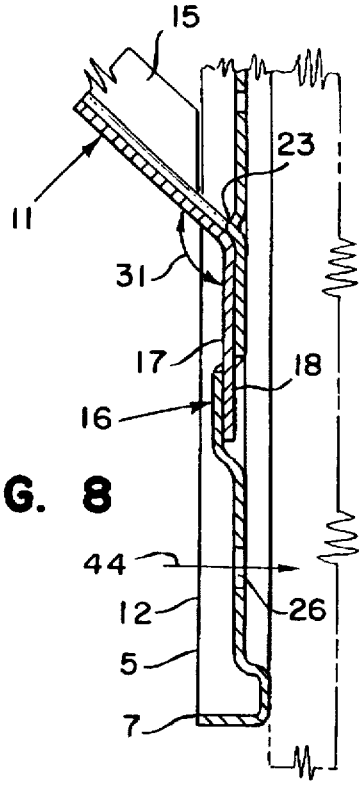
FIG. 8 is an enlarged scale cross section of a portion of the shelf bracket taken generally within the lines 8—8 in FIG. 6.

As may be seen from drawing FIGS. 7, 8 and 9, when load is applied to the bracket 1, strut 11 locks in place tightly as force applied on second end section 19 of strut member 11 forces projection 18 on first end section 17 of strut member 11 more tightly into socket 16.

When used inside homes, the shelf bracket 1, which requires no welding, may be painted to suit the decor of the room. When used in applications where aesthetics are not so important, the shelf bracket may remain unpainted or even galvanized for outdoor use.

Installation of the shelf bracket is easy to install with hand or power tools. As noted above the first and second elongated members 5 and 8 are uneven in length. Thus, if the generally horizontal shelf structure 3 is relatively long, the shelf bracket 1 may be rotated so that the longer first elongated member 5 may support the generally horizontal shelf structure and the second elongated member 8 may be attached to the generally vertical structure 2. Normally the shelf bracket 1 would be installed as shown in the drawings with first elongated member 5 attached to the generally vertical structure 2.

The preferred installation, thus, is to remove strut member 1 from generally L-shaped member 4 and to attach the first elongated member 5 to the generally vertical structure 2 such as the stud of a wall (not shown). Screws or nail fasteners as indicated by numbered arrows 44 may be inserted through fastener openings 26 in first elongated member 5. These may be easily inserted as there is no interference from strut member 11 which has been removed Next a generally horizontal shelf structure 3 is attached to second elongated member 8 by means of fasteners 44 placed through fastener openings 26 in the second elongated member 8. Next, strut member 11 is installed by first placing projection 18 in socket 16 as illustrated in FIG. 7. Note that distal edge 20 of strut member 11 extends beyond the inside surface portion 21 of flange 12 on the distal section 10 of second elongated member 8. It almost appears as illustrated in FIG. 7 that the strut is too long to be attached. The strut member 11, however, is easily installed, by simply pressing upwardly (as shown in FIG. 7 on any part of strut member 11 so that distal edge 20 swings upwardly as shown by arrow 45. Distal edge 20 engages the lower edge of flange 12 at point 46 as shown in FIG. 7. As pressure is continued on the underside of strut member 11, distal edge 20 slips over inside surface portion 21 of perimeter flange 12 and second end section 19 of strut member 11 snap locks firmly against surface portion 47 at the distal section 10 of second elongated member 8.

Figure 6:
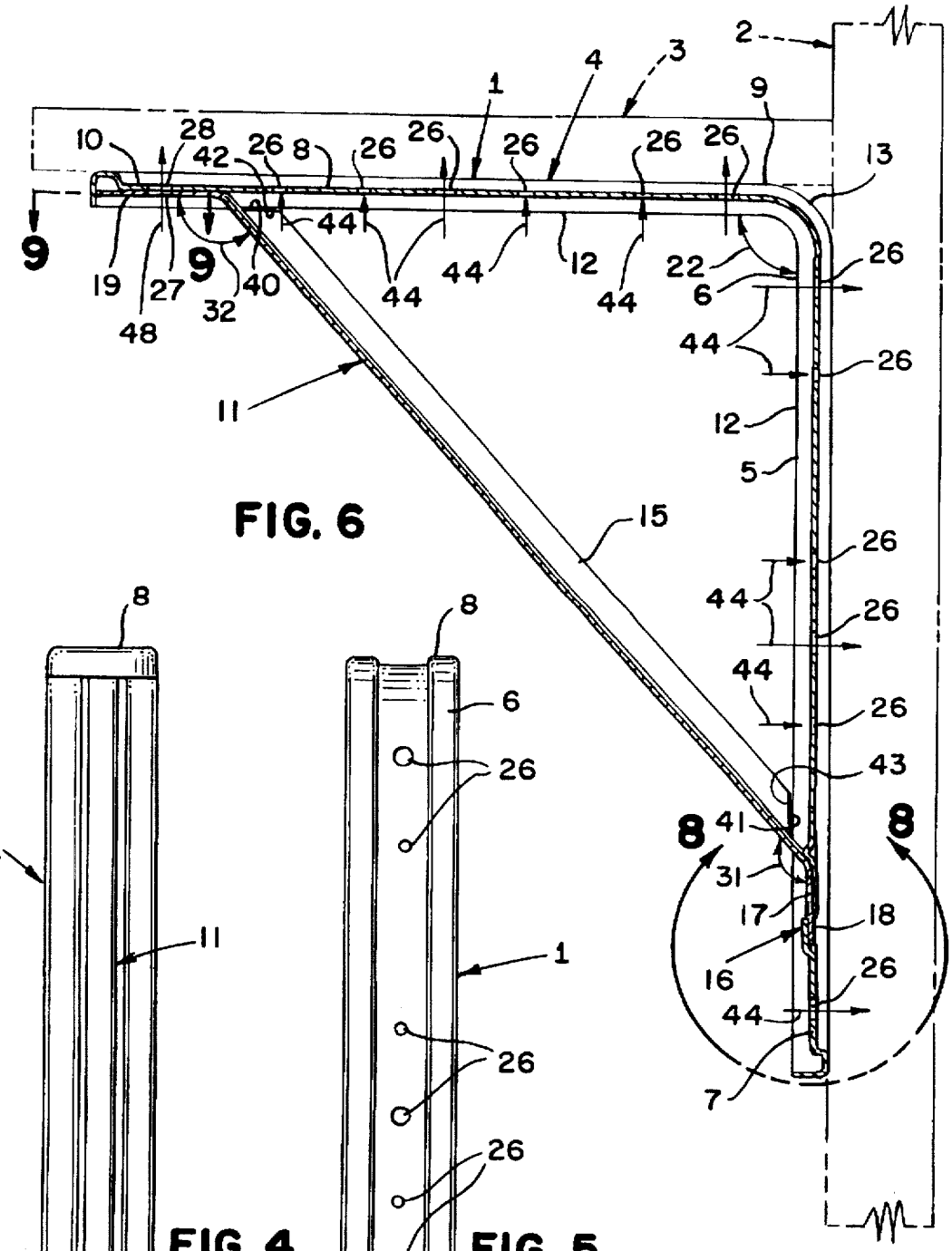
FIG. 6 is a cross sectional view of the shelf bracket taken along line 6—6 of FIG. 2.
Figure 4:
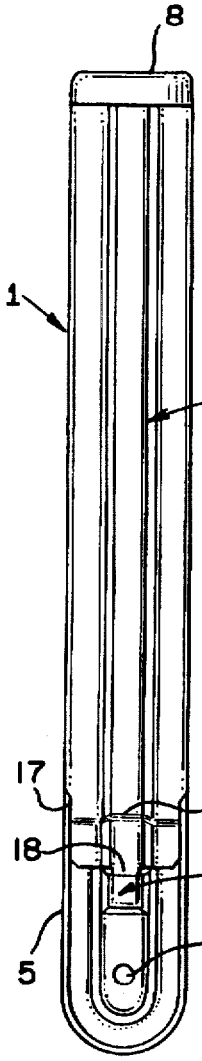
FIG. 4 is a front view of the shelf bracket taken in the direction of lines 4—4 in FIG. 1.
Figure 5:
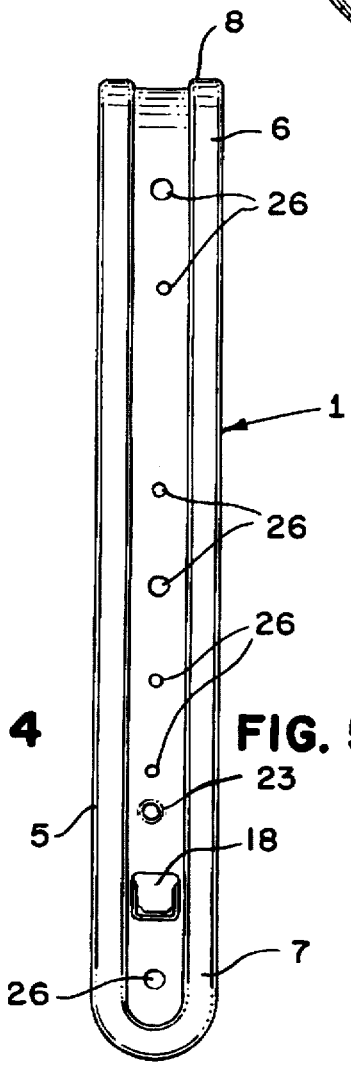
FIG. 5 is a rear elevation view of the shelf bracket taken in the direction of lines 5—5 in FIG. 1.

To lock strut member 11 to second elongated member 8, a screw or nail fastener as indicated by arrow 48 in FIGS. 6 and 7 may be inserted through fastener opening 27 in strut member 11 and through fastener opening 28 in second elongated member 8. This is easily accomplished because strut member does not have to be continued to be held since the strut is held at one end by projection 18 in socket 16, and the other end is snap locked into position as previously described. Thus the installer has both hands free to insert a fastener such as a screw indicated by arrow 48 through opening 27 and opening 28. As previously stated, the installation works equally well not matter whether the bracket is oriented as illustrated in the drawings or whether second elongated member 8 is mounted against generally vertical structure 2.

I claim:

1. A shelf bracket for attachment to a generally vertical structure and for holding a generally horizontal shelf member comprising:

a. a generally L-shape member having a first elongated member including a proximal and a distal section for selectable attachment to either said generally vertical structure or said generally horizontal shelf member and a second elongated member joined to said first elongated member at an angle for selectable attachment to the other of said generally vertical structure or said generally horizontal shelf member having a proximal section integrally attached to said proximal section of said first elongated member and a distal section;

b. a strut member dimensioned to extend between and engage said distal sections of said first and second elongated members:

c. a perimeter flange extending angularly from substantially the entire perimeter of said generally L-shaped member and extending as an unbroken continuous structural element at the intersection of said proximal sections of said first and second elongated members, and extending as an unbroken continuous structural element at said distal ends of said first and second elongated members, d. said shelf bracket is composed of two separable elements; viz., said L-shaped member and said strut member;

e. one of said first or second elongated members is formed with a socket permitting releasable attachment of said strut member to said generally L-shaped member;

f. said strut member includes a first end section formed with a projection dimensioned for releasable receipt within said socket formed in said generally L-shaped member;

g. said perimeter flange is formed with an inside surface portion at said distal section the other of said first or second elongated members: and h. said strut member is formed with a second end section having a distal edge and said strut member is dimensioned so that said distal edge of said second end section frictionally engages the inside surface portion of said perimeter flange at said distal section of the other of said first or second elongated members.

2. A shelf bracket as described in claim 1 wherein:

a. said strut member is formed with first and second flanges dimensioned and constructed for engagement with said perimeter flange of said first and second elongated members.

3. A shelf bracket as described in claim 2 wherein:

a. said strut member and said generally L-shaped member are dimensioned so that when said projection on said strut member has been received by said socket formed in said generally L-shaped member, said distal edge of said strut member extends beyond said inside surface portion of said perimeter flange on said distal section of said second elongated member of said generally L-shaped member and can only be received in engagement with said generally L-shaped member by increasing said angle formed by said juncture of said first and second elongated members; and b. said second end section of said strut member is frictionally held by said perimeter flange permitting snap-in engagement of said strut member with said generally L-shaped member.

4. A shelf bracket as described in claim 3 wherein:

a. said elongated member of said generally L-shaped member formed with said socket is formed with a projection spaced from said socket and dimensioned for releasably engaging said strut member for inhibiting withdrawal of said strut member from said socket.

5. A shelf bracket as described in claim 4 wherein:

a. said strut member is formed with an elongated indented section running substantially the length of said strut member; and b. said generally L-shaped member is formed with an elongated indented section running substantially the length of said generally L-shaped member.

6. A shelf bracket as described in claim 5 wherein:

a. said generally L-shaped member is formed with fastener openings to facilitate the passage of fasteners therethrough into said generally horizontal shelf member and said generally vertical structure; and b. said second end section of said strut member is formed with a fastener opening in registration with one of said fastener openings in said generally L-shaped member for clamping said strut member to said generally L-shaped member.

7. A shelf bracket as described in claim 6 wherein:

a. said first and second end sections of said strut member are free of said first and second flanges and are formed with first and second angular bends so that said first and second end sections of said strut member lie in generally face to face registration with said distal sections of said first and second elongated members of said generally L-shaped member.

* * * * *

UNITED STATES PATENT AND TRADEMARK OFFICE

CERTIFICATE OF CORRECTION

PATENT NO. : 5,755,416

DATED : May 26, 1998

INVENTOR(S) : William F. Leek

It is certified that error appears in the above-identified patent and that said Letters Patent is hereby corrected as shown below:

Column 4, line 10, after "Perimeter flange 12 may" delete "30"

Column 5, line 24, after "equally well" change "not" to ---no---

Column 6, line 2, after "said distal section" insert ---of---

Signed and Sealed this

Eighteenth Day of August, 1998

Bruce Lehman

*Attest:*

BRUCE LEHMAN

*Attesting Officer*

*Commissioner of Patents and Trademarks*